US006367950B1

(12) United States Patent
Yamada et al.

(10) Patent No.: US 6,367,950 B1
(45) Date of Patent: Apr. 9, 2002

(54) VEHICLE LAMP FIXTURE AND METHOD OF USE

(75) Inventors: Tetsuo Yamada; Kenji Mitani, both of Yokohama; Masaki Umemoto, Tokyo, all of (JP)

(73) Assignee: Stanley Electric Co., Ltd., Tokyo (JP)

( * ) Notice: Subject to any disclaimer, the term of this patent is extended or adjusted under 35 U.S.C. 154(b) by 0 days.

(21) Appl. No.: 09/383,380

(22) Filed: Aug. 26, 1999

(30) Foreign Application Priority Data

Aug. 27, 1998 (JP) ..... 10-241481

(51) Int. Cl.[7] ..... F21V 5/00

(52) U.S. Cl. ..... 362/245; 362/516; 362/545; 362/241; 362/328; 362/341

(58) Field of Search ..... 362/488, 509, 362/516, 520, 545, 237, 245, 297, 304, 309, 327, 800, 241, 328, 341, 342, 343, 347, 350

(56) References Cited

U.S. PATENT DOCUMENTS 2,215,900 A * 9/1940 Bitner ..... 362/309
2,254,962 A * 9/1941 Harris et al. ..... 362/327
2,469,080 A * 5/1949 Rosin et al. ..... 362/327
5,438,487 A * 8/1995 Schmid et al. ..... 362/460
5,894,195 A * 4/1999 McDermott ..... 362/512

FOREIGN PATENT DOCUMENTS

| | | |
|---|---|---|
| JP | 63-64005 | 12/1988 |
| JP | 4-36590 | 6/1992 |
| JP | 4-66112 | 10/1992 |

* cited by examiner

*Primary Examiner*—Sandra O'Shea
*Assistant Examiner*—Ismael Negron
(74) *Attorney, Agent, or Firm*—Morgan, Lewis & Bockius LLP

(57) ABSTRACT

A vehicle lamp fixture is disclosed in which a truncated bowl-shaped reflector 6 is formed as a single unit in front of each respective LED 5. Each reflector is formed from a transparent substance and has an aperture in the front surface. Each reflector also has a reflective surface 6*b* that totally reflects light from the LED 5 and a light conductive member 6*c* that conducts at least a portion of light reflected by the reflective surface toward the front of the light fixture. A transparent front lens can thereby be used that does not include light-distributing facets.

15 Claims, 3 Drawing Sheets

VEHICLE LAMP FIXTURE AND METHOD OF USE

This invention claims the benefit of Japanese Patent Application No. 10-241481, filed on Aug. 27, 1998, which is hereby incorporated by reference.

BACKGROUND OF THE INVENTION

1. Field of the Invention

The invention relates to a lamp fixture. Specifically, the invention relates to a vehicle lamp fixture that utilizes a plurality of LEDs as light sources and that is placed at the rear portion of the vehicle as a rear combination lamp (tail light/brake light or high mount stop lamp, etc.) to provide warning, or otherwise communicate, etc. to other persons and especially to following vehicles.

2. Description of Related Art

Prior art versions of vehicle lamp fixtures are generally known, such as those shown in FIGS. 4 and 5. FIG. 4 is a vertical cross-sectional drawing of one example of a related art vehicle lamp fixture 90. FIG. 5 is a vertical cross-sectional drawing of another example of a related art type vehicle lamp fixture 80.

Each of the vehicle lamp fixtures 80 or 90 has a lamp housing 81 or 91, respectively, that is formed as a container with a front aperture. This front aperture is covered by a lens 82 or 92 attached by appropriate means such as ultrasonic welding, adhesive gluing, etc. A plurality of LEDs 84 or 94 are arranged on a printed circuit board 83 or 93, respectively, at a specific spacing in a row or in a vertical-horizontal array.

As shown in FIG. 4, control facets 92*a* such as prism facets, fish-eye facets, semicylindrical facets, etc. are provided upon the interior surface of lens 92 for each respective LED 94 so as to form a grid of control facets 92*a*. Each control facet 92*a* is formed so that the center of the control facet 92*a* roughly coincides with the optical axis of a LED 94. Accordingly, the light beam emitted by each LED 94 is refracted along the LED 94 optical axis by control facet 92*a* so as to shine in the forward direction.

Furthermore, as shown in FIG. 5, a reflector 85 is provided that has a truncated rotating paraboloidal reflective surface 85*b* on the interior surface of the reflector 85. A LED through hole 85*a* is formed at the backside-apex portion corresponding to each LED 84. Each LED 84 passes through the LED through hole 85*a* and is mounted at the approximate focal point of reflective surface 85*b*. An array pattern of diffusion lens facets 82*a* is provided on the interior surface of lens 82. The light beam emitted directly forward by each LED 84 thereby illuminates the diffusion lens facet 82*a* of lens 82 and shines forward as an appropriately diffused beam. Light directed toward reflective surface 85*b* is reflected as collimated light nearly parallel with the optical axis of LED 84. This reflected light then illuminates diffusion facet 82*a* and shines forward as an appropriately diffused beam.

Related art LED light source vehicle light fixtures are typically equipped with a lens 92 or 82 that has an interior surface provided with a grid pattern of control facets 92*a* (prism facets, etc.) or diffusion lens facets 82*a*, respectively. The existence of such lens facets gives the impression that the lens is not clear so that the non-illuminated vehicle LED lamp fixture differs little in appearance from one which uses a normal incandescent bulb. This results in a problem to be solved: the sense of uniqueness of a LED light source is not apparent, and the related art vehicle lamp fixture appears to be a typical, uninteresting everyday lamp fixture.

SUMMARY OF THE INVENTION

As a specific solution to the problems in the related art, the invention provides a vehicle lamp fixture that includes a lamp fixture comprising a housing having a front portion with an aperture in said front portion, a lens located adjacent said aperture in said front portion of the housing, an LED placed at a predetermined location within the housing, and a reflector member formed as a single unit and including a truncated bowl-shaped portion located in front of said LED, said reflector member being formed from a transparent substance and including, a front surface with an aperture, a reflective surface that reflects light from the LED, and a light conductive portion that conducts at least a portion of light reflected by the reflective surface in a predetermined direction.

BRIEF DESCRIPTION OF THE DRAWINGS

The accompanying drawings, which are incorporated in and constitute a part of this specification, illustrate several embodiments of the invention and together with the description, serve to explain the principles of the invention.

Figure 1:
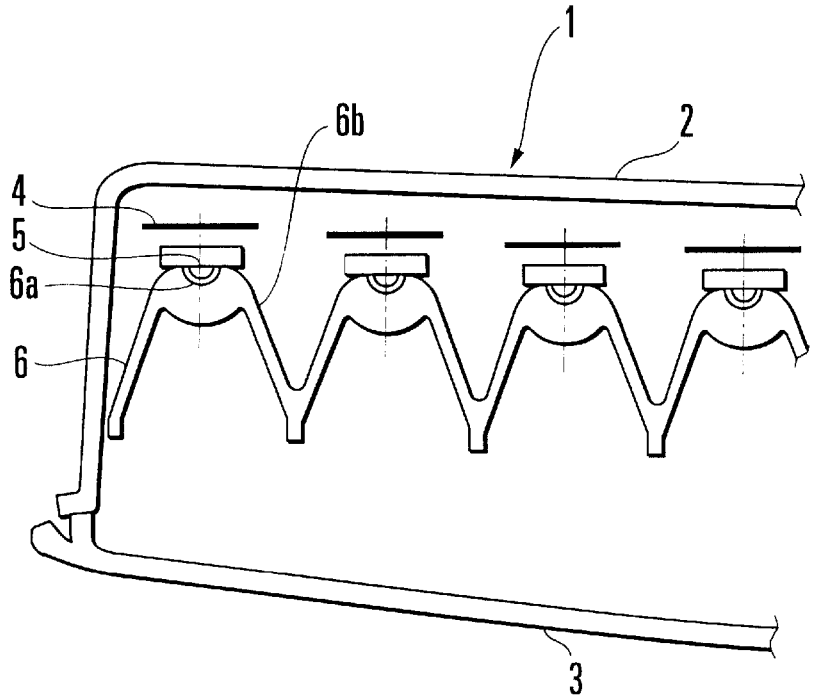
FIG. 1 is a partial cross-sectional drawing of an embodiment of the vehicle lamp fixture made in accordance with the principles of the invention.

The invention is next explained in detail based upon embodiments of the invention as shown in the drawings.

DETAILED DESCRIPTION OF THE PREFERRED EMBODIMENTS

FIG. 1 shows an embodiment of the vehicle lamp fixture made in accordance with the principles of the invention. The vehicle lamp fixture 1 can have a lamp housing 2 that is formed as a container with a front aperture. The front aperture can be covered by a lens 3 attached by appropriate means such as ultrasonic welding, adhesive gluing, etc. Within housing 2, a plurality of LEDs 5 can be placed side-by-side on a printed circuit board 4 in a row or in a vertical-horizontal array.

Figure 2:
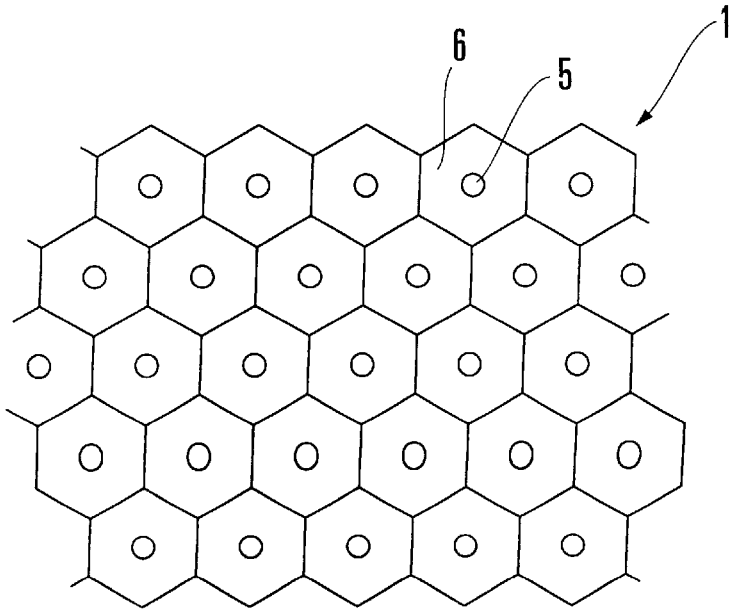
FIG. 2 is a partial front view of the lamp fixture shown in FIG. 1.

The lamp fixture 1 can include a reflector member. The reflector member can include a plurality of reflectors, such as truncated bowl-shaped reflectors 6, each placed in front of a respective LED 5 and formed from a transparent substance to have an apertured front surface. As shown in FIG. 2, the front aperture edges of the reflectors can be formed as hexagons (as seen from the front). The hexagon shapes can form a single unit with adjacent aperture edges of the reflectors and are connected together without gaps.

Figure 3:
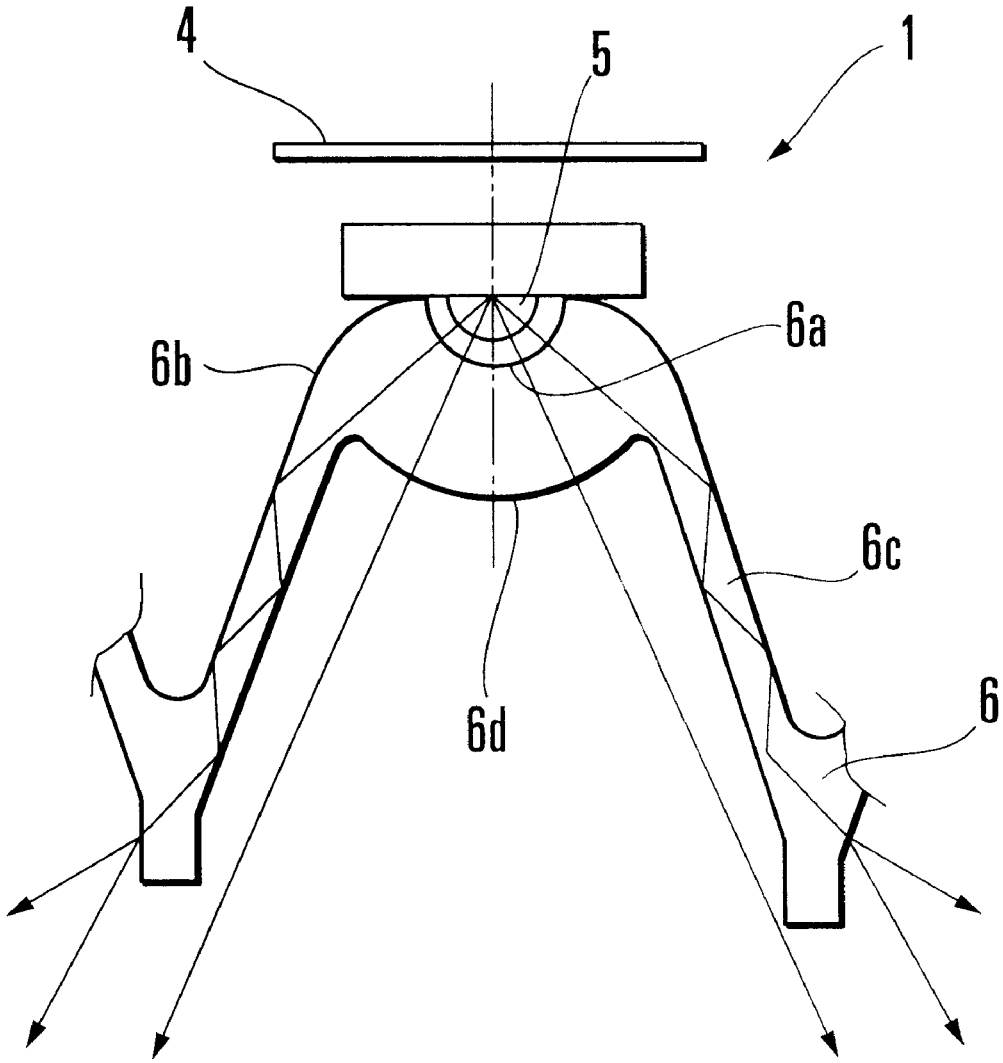
FIG. 3 is a partial cross-sectional view of the lamp fixture shown in FIG. 1.
Figure 4:
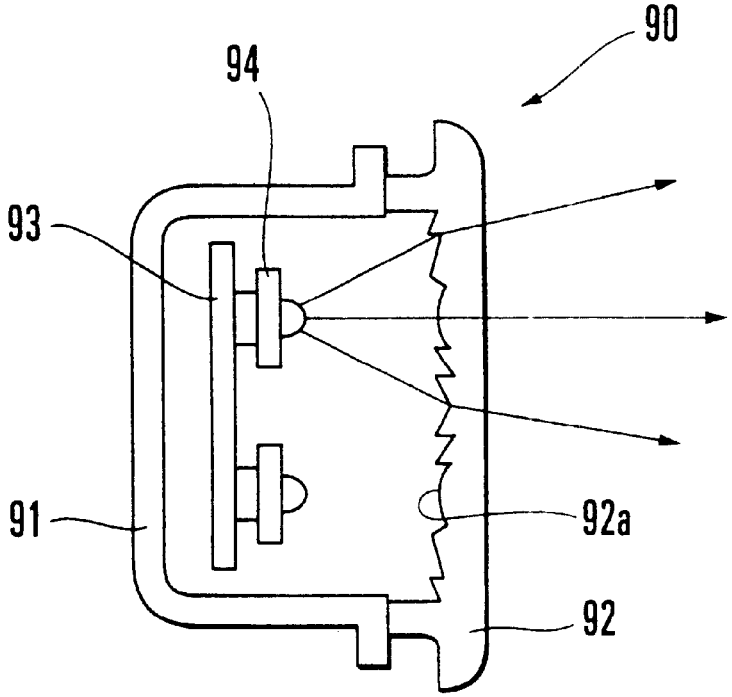
FIG. 4 RELATED ART
FIG. 4 is a cross-sectional view of an example of a related art lamp.
Figure 5:
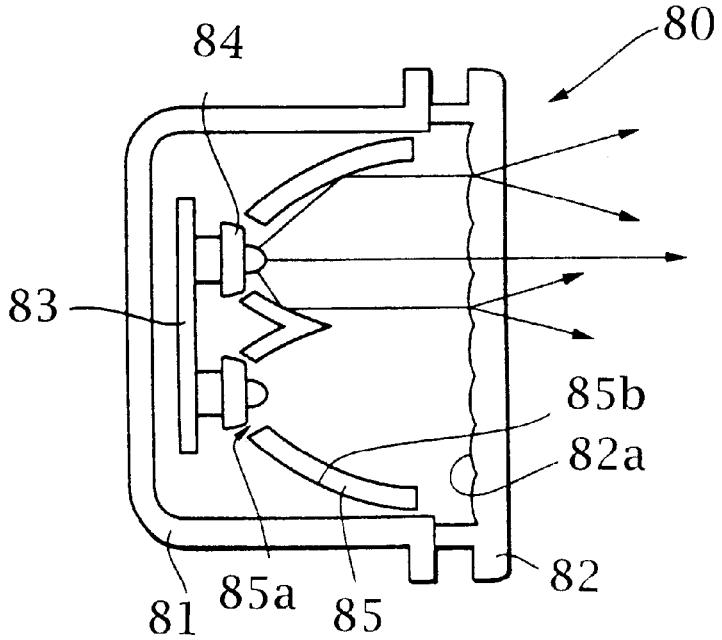
FIG. 5 RELATED ART
FIG. 5 is a cross-sectional view of another example of a related art lamp.

The relationship between each LED 5 and reflector 6 is shown in detail in FIG. 3. In FIG. 3, reflector 6 is formed as a truncated bowl-shape molding of transparent plastic that is clear or colorless and that has a front surface aperture A concavity 6*a* that is adapted to contain a LED 5 is formed at the backside of the apex portion of the reflector 6, and a protuberance 6*d* is formed upon the frontside of the apex portion of the reflector 6. A reflective surface 6*b* can be provided to totally reflect light from LED 5. The reflective surface 6*b* can be formed upon a portion of the backside of the reflector by appropriate treatment such as aluminum vacuum deposition or total reflection prism faceting. A portion of the light reflected from reflective surface 6*b* can be conducted through a light conductive member 6*c* toward the front of the light fixture. The reflector can be constructed as a single unit including the concavity 6*a*, reflective surface 6*b*, the light conductive member 6*c* and the protuberance 6*d*.

Due to the above described construction, light from the LED 5 light source is reflected by reflective surface 6*b* of reflector 6. At least a portion of this reflected light is conducted within reflector 6 by light conductive member 6*c*. The light is diffused by scattering reflections within the light conductive member 6*c*. The fraction of light that is utilized is thereby increased, and a uniform light emission can be obtained. Furthermore, scattering of light by the light conducting member 6*c* also improves lamp visibility when viewed from an off-axis angle while the vehicle lamp fixture is illuminated. Accordingly, a lens 3 that does not include light distribution faceting can be used in the invention.

Without faceting on the lens 3, the reflector 6 is readily seen from outside of the lamp fixture, even when the lamp fixture is not illuminated. Thus, the structural shape and color design of the reflector can be chosen to improve the aesthetic appearance of the vehicle lamp fixture. The lamp of the invention provides an attractive appearance and gives a sense of novelty and luxury to the vehicle or other device to which it is mounted.

In addition, since the reflectors can be formed as a single unit in which the aperture edges are connected without gaps, all reflector regions can be used to distribute light and the efficiency of light emitted by LED 5 can be increased. Furthermore, light conductive members 6*c* can be located at the connecting portions between each reflector 6 to prevent darkening of the connecting portions.

Light emitted directly from LED 5 passes through protuberance 6*d* of reflector 6. Therefore LED 5 light is condensed as a result of the convex lens formed by protuberance 6*d*, thereby further increasing the efficiency of light emitted from LED 5. Furthermore, when the lamp fixture is not illuminated, LED 5 appears magnified due to the convex lens formed by protuberance 6*d*. Thus, an increased visual impression of the existence of LED 5 is provided and the use of an LED 5 light source is further emphasized.

The above described embodiment utilizes a LED 5, a concavity 6*a* formed on the backside of the apex portion of reflector 6, and a protuberance 6*d* formed upon the opposing frontside surface. However, the concavity 6*a* and/or the frontside protuberance 6*d* can be used alone in the reflector, or alternatively, flat surfaces can be provided in the lens portions 6*a* and/or 6*d* that are adjacent the LED 5. The concavity 6*a* or the protuberance 6*d* can include different shapes at the front and backside as long as utilization of light is increased and a sufficiently uniform light distribution is obtained due to the above mentioned reflective surface 6*b* and light conducting members 6*c*.

Furthermore, the vehicle lamp of the invention is not restricted to the use of a concavity 6*a* or protuberance 6*d* in the reflector 6 since illumination and visibility are improved at off-axis viewing angles due to light scattered by light conducting member 6*c* during illumination.

Although the above embodiments include reflectors 6 with a hexagonal profile when viewed from the front, the invention is not limited to the use of such reflectors 6. Other shapes can be selected in which adjacent reflectors can be connected to form a single unit. Other shapes that are permissible include polygonal shapes (triangles, rectangles, pentagons, etc.), circles, ellipses, etc. Specifically, polygonal shapes can be used to obtain the same result as the hexagonal shaped embodiment since adjacent reflectors can form continuous and connected edges without gaps at the aperture edges. However, gaps form at the contact points between adjacent circles when a circular shape is used, resulting in gaps between the reflectors 6. In this case, for example, the same type of result can be obtained by forming light conducting member 6*c* as a single unit together with gap portions.

As explained above, the invention is a vehicle lamp fixture that is equipped with a plurality of LEDs as light sources. A truncated bowl-shaped reflector can be provided in front of each respective LED, and the reflector can be formed from a transparent substance with an aperture in the front surface. This reflector is formed with a reflective surface that totally reflects light from the LED, and a light conductive member that conducts at least a portion of light reflected by the reflective surface toward the front of the light fixture. Therefore light is more efficiently utilized by the invention, and light distribution is more uniform. When the vehicle lamp fixture is illuminated, lamp visibility from off-axis angles is improved.

In addition, a front lens that does not include light distribution faceting can be used with the vehicle lamp made in accordance with the invention. Accordingly, the LED and reflector member's structural shape and color design is readily visible through the front lens when the lamp fixture is not illuminated, thereby providing an attractive appearance that gives a sense of novelty and luxury to the lamp fixture.

It will be apparent to those skilled in the art that various changes and modifications can be made therein without departing from the spirit and scope of the invention. Thus, it is intended that the invention cover the modifications and variations of this invention provided they come within the scope of the appended claims and their equivalents.

What is claimed is:

1. A lamp fixture comprising:

a housing having a front portion with an aperture in said front portion;

a lens located adjacent said aperture in said front portion of the housing;

an LED placed at a predetermined location within the housing; and a reflector member formed as a single unit and including a truncated bowl-shaped portion located in front of said LED, said reflector member being formed from a transparent substance and including:

a front surface with an aperture, a reflective surface that reflects light from the LED, and a light conductive portion that conducts at least a portion of light reflected by the reflective surface in a predetermined direction.

2. The lamp fixture as claimed in claim 1, wherein said reflector member includes a plurality of reflectors with aperture edges, and the reflector member is formed as a single unit by connection of adjacent reflectors at their respective aperture edges.

3. The lamp fixture as claimed in claim 1, wherein the reflector member includes a plurality of reflectors with aperture edges, and the reflector member is formed as a contiguous single unit by connection of adjacent reflectors at their respective aperture edges without gaps, and the aperture edges form substantially polygonal shapes.

4. The lamp fixture as claimed in claim 1, wherein the reflector member includes a backside-apex portion and a frontside surface, and a concavity adapted to be adjacent the LED is formed in the backside-apex portion of the reflector member, and an opposing protuberance is formed in the frontside surface of the reflector member.

5. The lamp fixture as claimed in claim 1, wherein the lamp fixture is adapted for use in a vehicle.

6. The lamp fixture as claimed in claim 1, further comprising:

a board located within the housing, said LED being located on said board.

7. The lamp fixture as claimed in claim 1, wherein said lamp fixture includes a front portion and said predetermined direction in which said light conductive member conducts at least a portion of light reflected by said reflective surface is towards said front portion of said lamp fixture.

8. The lamp fixture as claimed in claim 1, wherein said reflective surface of said reflector totally reflects light emitted from said LED.

9. The lamp fixture as claimed in claim 1, further comprising:

a plurality of LEDs located at predetermined positions within said housing.

10. The lamp fixture as claimed in claim 9, wherein said reflector member includes a plurality of reflectors, each of said reflectors including an aperture located adjacent a corresponding one of said plurality of LEDs.

11. The lamp fixture as claimed in claim 10, wherein each of said reflectors includes a truncated bowl-shaped portion located in front of a corresponding one of said plurality of LEDs.

12. A lamp fixture, comprising:

a housing having an aperture and an interior area viewable through said aperture;

an LED located within said interior area of said housing;

a transparent lens located in said aperture of said housing, said lens having a substantially smooth inner surface and a substantially smooth outer surface such that said interior area of said housing can be viewed from a location outside said housing; and a reflector member located adjacent said LED, viewable from a location outside of said housing and including: means for illuminating the entire reflector member when the LED is illuminated; and a plurality of reflectors having a concave portion and an edge formed about a perimeter of the concave portion, each of said reflectors being connected to an adjacent one of said reflectors at their respective edges without gaps such that the reflectors form an uninterrupted and continuous reflector member, and the edges form substantially polygonal shapes.

13. The lamp fixture as claimed in claim 12, wherein the reflector member includes a front side having a concave portion and a back side with a partial reflective coating, said back side having a concave portion located adjacent said LED.

14. The lamp fixture as claimed in claim 12, further comprising:

a plurality of LEDs located within said housing; and a reflector member including a plurality of reflectors located adjacent a corresponding one of said plurality of LEDs, wherein said reflector member is formed from a transparent substance and includes:

a front surface with an aperture;

a reflective surface that can reflect light emitted from the LED; and a light conductive portion that can conduct at least a portion of light reflected by the reflective surface in a predetermined direction.

15. A method for illuminating a vehicle lamp fixture, comprising:

providing a housing with a reflector member located therein, said reflector member being partially constructed from a transparent material;

providing a plurality of LEDs and a plurality of reflectors in said housing, each of said reflectors connected to an adjacent one of said reflectors without gaps to form said reflector member, each of said reflectors including a concave portion located adjacent to a corresponding one of said plurality of LEDs and an edge substantially forming a polygonal shape; and illuminating each of the plurality of reflectors by supplying power to the LEDs such that substantially the entire reflector member is illuminated and the reflectors can be viewed at a plurality of viewing angles from outside said housing.

* * * * *